US010468742B2

(12) United States Patent
So

(10) Patent No.: US 10,468,742 B2
(45) Date of Patent: Nov. 5, 2019

(54) ANTENNA HINGE CONNECTOR

(71) Applicant: Dogtra co., Ltd., Incheon (KR)

(72) Inventor: Min Kyun So, Seoul (KR)

(73) Assignee: Dogtra Co., Ltd., Incheon (KR)

( * ) Notice: Subject to any disclaimer, the term of this patent is extended or adjusted under 35 U.S.C. 154(b) by 30 days.

(21) Appl. No.: 15/728,021

(22) Filed: Oct. 9, 2017

(65) Prior Publication Data

US 2019/0067811 A1 Feb. 28, 2019

(30) Foreign Application Priority Data

Aug. 25, 2017 (KR) ..... 10-2017-0107764

(51) Int. Cl.
*H01Q 1/08* (2006.01)
*H01Q 1/27* (2006.01)
*H01Q 1/24* (2006.01)

(52) U.S. Cl.
CPC ..... *H01Q 1/084* (2013.01); *H01Q 1/088* (2013.01); *H01Q 1/273* (2013.01); *H01Q 1/242* (2013.01)

(58) Field of Classification Search
CPC ..... H01Q 1/084; H01Q 1/088; H01Q 1/10; H01Q 1/125; H01Q 1/273; H01Q 1/24; H01Q 3/04; H01Q 3/06; H01Q 3/08
See application file for complete search history.

(56) References Cited

U.S. PATENT DOCUMENTS 5,218,370 A * 6/1993 Blaese ..... H01Q 1/084 343/702
5,422,651 A * 6/1995 Chang ..... H01Q 1/084 343/702
6,222,506 B1 4/2001 So

FOREIGN PATENT DOCUMENTS

KR 2020110010981 11/2011
KR 1020120043420 5/2012
KR 1020140063928 5/2014

OTHER PUBLICATIONS

Office Action issued by the Korean Intellectual Property Office dated Jul. 10, 2018.

* cited by examiner

*Primary Examiner* — Robert Karacsony
(74) *Attorney, Agent, or Firm* — IP & T Group LLP

(57) ABSTRACT

An antenna hinge connector that is installed between a transmitter body and an antenna is provided. The antenna hinge connector includes: a base body in which a body connecting portion corresponding to an antenna installation groove of the transmitter body is formed on a bottom surface thereof and a hinge coupling piece is installed to protrude from a top surface thereof; a pivot body in which an antenna connecting groove corresponding to a connecting portion of the antenna is formed on a top surface thereof and a base coupling pieces corresponding to the hinge coupling piece is installed to protrude from a bottom surface; and a rotating coupling portion that rotatably couples the hinge coupling piece and the base coupling piece. Here, the body connecting portion is connected to the transmitter body and the antenna is connected to the antenna connecting groove.

7 Claims, 8 Drawing Sheets

ANTENNA HINGE CONNECTOR

CROSS-REFERENCE TO RELATED APPLICATIONS

The present application claims priority of Korean Patent Application No. 10-2017-0107764, filed on Aug. 25, 2017, which is incorporated herein by reference in its entirety.

BACKGROUND OF THE INVENTION

Field of the Invention

The present invention relates to an antenna hinge connector.

Description of Related Art

A transceiver of an animal training device includes a transmitting/receiving antenna to transmit or receive a signal of a specific frequency band.

FIG. 1 is a diagram illustrating a transceiver of an animal training device according to the related art.

A transmitting/receiving antenna 10 is installed in a transceiver body 1 of an animal training device. At a lower end of the transmitting/receiving antenna 10, a connecting portion 12 is installed to protrude and is screwed to an antenna installation groove 11 formed on a top surface of the transceiver body 1. A screw thread corresponding to an outer surface of the connecting portion 12 is formed on an inner circumferential surface of the antenna installation groove 11.

The transmitting/receiving antenna 10 is configured to be fixedly installed in the transceiver body 1, and provides such a problem in wearing and use that the transmitting/receiving antenna 10 thrusts a user's body when a user wears the transceiver body 1 in the form of a necklace. There is also a problem in that the transmitting/receiving antenna 10 faces upward and thus transmission/reception range of a signal thereof decreases.

The above description in the Description of Related Art is only for easily understanding the background art of the invention, and does not means that it corresponds to the prior art known to those skilled in the art.

An example of the related art is disclosed in U.S. Pat. No. 6,222,506, "TRANSMITTING AND RECEIVING ANTENNA FOR ANIMAL TRAINING DEVICE."

SUMMARY

The invention provides an antenna hinge connector that is coupled to a connecting portion of an existing antenna to enable a pivoting and/or swiveling operation of the antenna.

Other technical objects of the invention will be easily understood from the following description.

According to an aspect of the invention, there is provided an antenna hinge connector that is installed between a transmitter body and an antenna, the antenna hinge connector including: a base body in which a body connecting portion corresponding to an antenna installation groove of the transmitter body is formed on a bottom surface thereof and a hinge coupling piece is installed to protrude from a top surface thereof; a pivot body in which an antenna connecting groove corresponding to a connecting portion of the antenna is formed on a top surface thereof and a base coupling pieces corresponding to the hinge coupling piece is installed to protrude from a bottom surface; and a rotating coupling portion that rotatably couples the hinge coupling piece and the base coupling piece, wherein the body connecting portion is connected to the transmitter body and the antenna is connected to the antenna connecting groove.

The pivot body may rotate about the base body when a pivoting operation is performed.

A washer may be interposed between the hinge coupling piece and the base coupling piece.

According to another aspect of the invention, there is provided an antenna hinge connector that is installed between a transmitter body and an antenna, the antenna hinge connector including: a base body in which a body connecting portion corresponding to an antenna installation groove of the transmitter body is formed on a bottom surface thereof and a swivel connecting portion is formed on a top surface thereof; a swivel body in which a swivel connecting hole corresponding to the swivel connecting portion is formed on a bottom surface thereof to fasten the swivel body to the base body to swivel and a hinge coupling piece is installed to protrude from a top surface thereof; a pivot body in which an antenna connecting groove corresponding to a connecting portion of the antenna is formed on a top surface thereof and a base coupling pieces corresponding to the hinge coupling piece is installed to protrude from a bottom surface; and a rotating coupling portion that rotatably couples the hinge coupling piece and the base coupling piece, wherein the body connecting portion is connected to the transmitter body and the antenna is connected to the antenna connecting groove.

A leaf spring in which a fastening protrusion is formed on a top surface thereof may be interposed between the base body and the swivel body, and a fastening groove corresponding to the fastening protrusion may be formed on the bottom surface of the swivel body.

Alternatively, a leaf spring in which a fastening groove is formed on a top surface thereof may be interposed between the base body and the swivel body, and a fastening protrusion corresponding to the fastening groove may be formed on the bottom surface of the swivel body.

A plurality of fastening grooves may be arranged in a radial shape, and a fixable minimum angle when the swivel body swivels may be determined depending on an angle between the fastening grooves.

The pivot body may rotate about the swivel body when a pivoting operation is performed.

A washer may be interposed between the hinge coupling piece and the base coupling piece.

Other aspects, features, and advantages of the invention will become apparent from the accompanying drawings, the appended claims, and the detailed description.

According to the aspects of the invention, it is possible to arbitrarily adjust a direction of an antenna, to improve a user's feeling of wearing, and to enhance transmitting/receiving sensitivity, by coupling an antenna hinge connector to a connecting portion of an existing antenna to enable a pivoting and/or swiveling operation of the antenna.

It is possible to fix an antenna at a desired swivel angle using a leaf spring and to fix a direction of a plane on which the antenna is pivoted.

Since the invention can be applied to an existing antenna, it is possible to reduce a user's burden by adding only the antenna hinge connector without replacing a transceiver body.

DESCRIPTION OF EXEMPLARY EMBODIMENTS OF THE INVENTION

Figure 1:
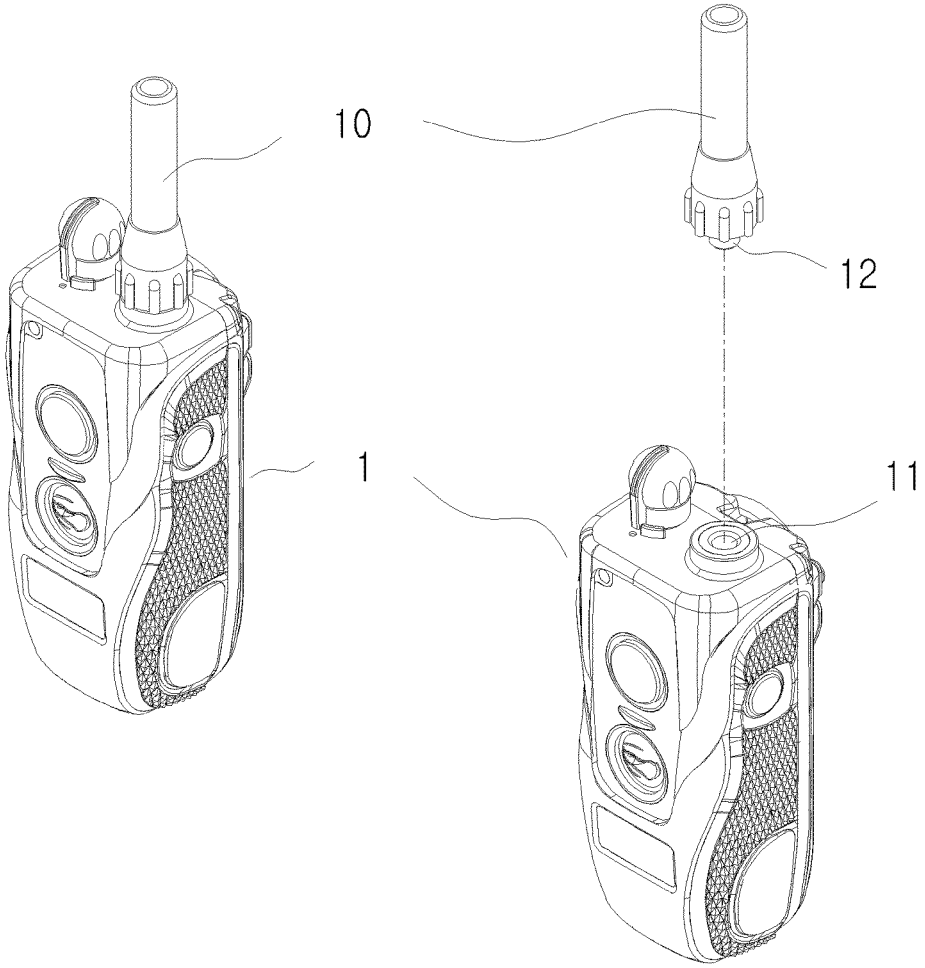
FIG. 1 (Prior Art)
FIG. 1 is a diagram illustrating a transceiver of an animal training device according to the related art.

The invention can be modified in various forms and specific embodiments will be described and shown below. However, the embodiments are not intended to limit the invention, but it should be understood that the invention includes all the modifications, equivalents, and replacements belonging to the concept and the technical scope of the invention.

If it is mentioned that an element is "connected to" or "coupled to" another element, it should be understood that still another element may be interposed therebetween, as well as that the element may be connected or coupled directly to another element. On the contrary, if it is mentioned that an element is "connected directly to" or "coupled directly to" another element, it should be understood that still another element is not interposed therebetween.

The terms used in the following description are intended to merely describe specific embodiments, but not intended to limit the invention. An expression of the singular number includes an expression of the plural number, so long as it is clearly read differently. The terms such as "include" and "have" are intended to indicate that features, numbers, steps, operations, elements, components, or combinations thereof used in the following description exist and it should thus be understood that the possibility of existence or addition of one or more other different features, numbers, steps, operations, elements, components, or combinations thereof is not excluded.

Terms "first," "second," and the like can be used to describe various elements, but the elements should not be limited to the terms. The terms are used only to distinguish an element from another.

Terms such as "unit" and "module" and described in the specification mean units for performing at least one function or operation and can be embodied by hardware, by software, or by a combination of hardware and software.

Elements of an embodiment described below with reference to the accompanying drawings are not limited to the corresponding embodiment, may be included in another embodiment without departing from the technical spirit of the invention. Although particular description is not made, plural embodiments may be embodied as one embodiment.

In describing the invention with reference to the accompanying drawings, like elements are referenced by like reference numerals or signs regardless of the drawing numbers and description thereof is not repeated. If it is determined that detailed description of known techniques involved in the invention makes the gist of the invention obscure, the detailed description thereof will not be made.

Figure 2:
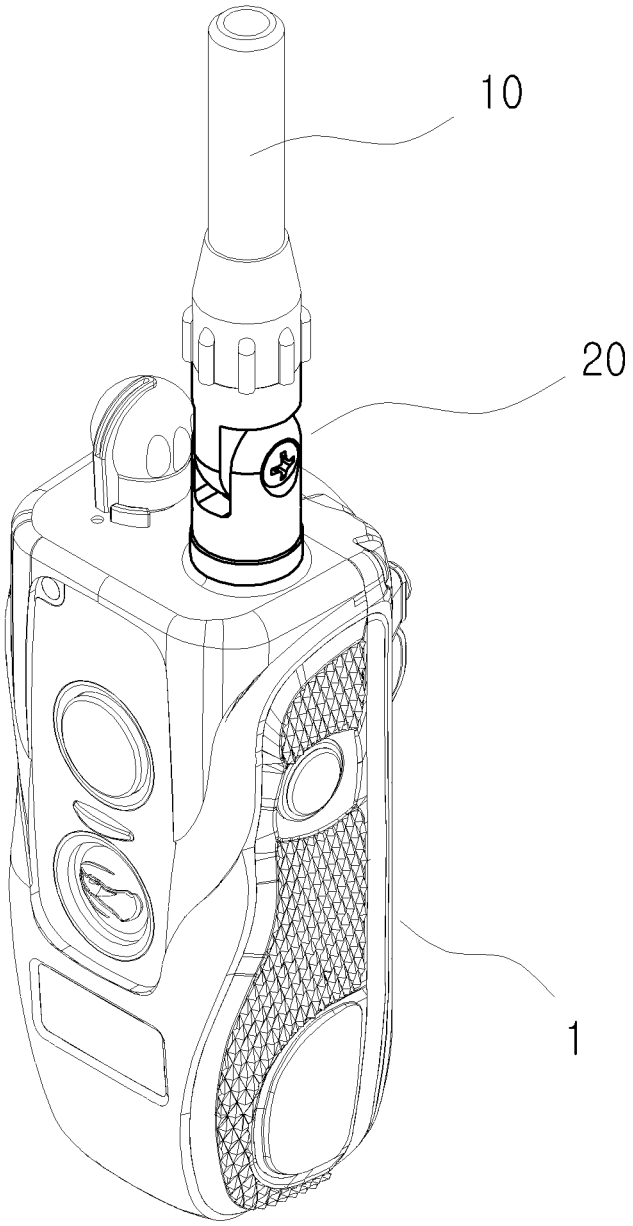
FIG. 2 is a diagram illustrating a state in which an antenna hinge connector is assembled according to an embodiment of the invention.
Figure 3:
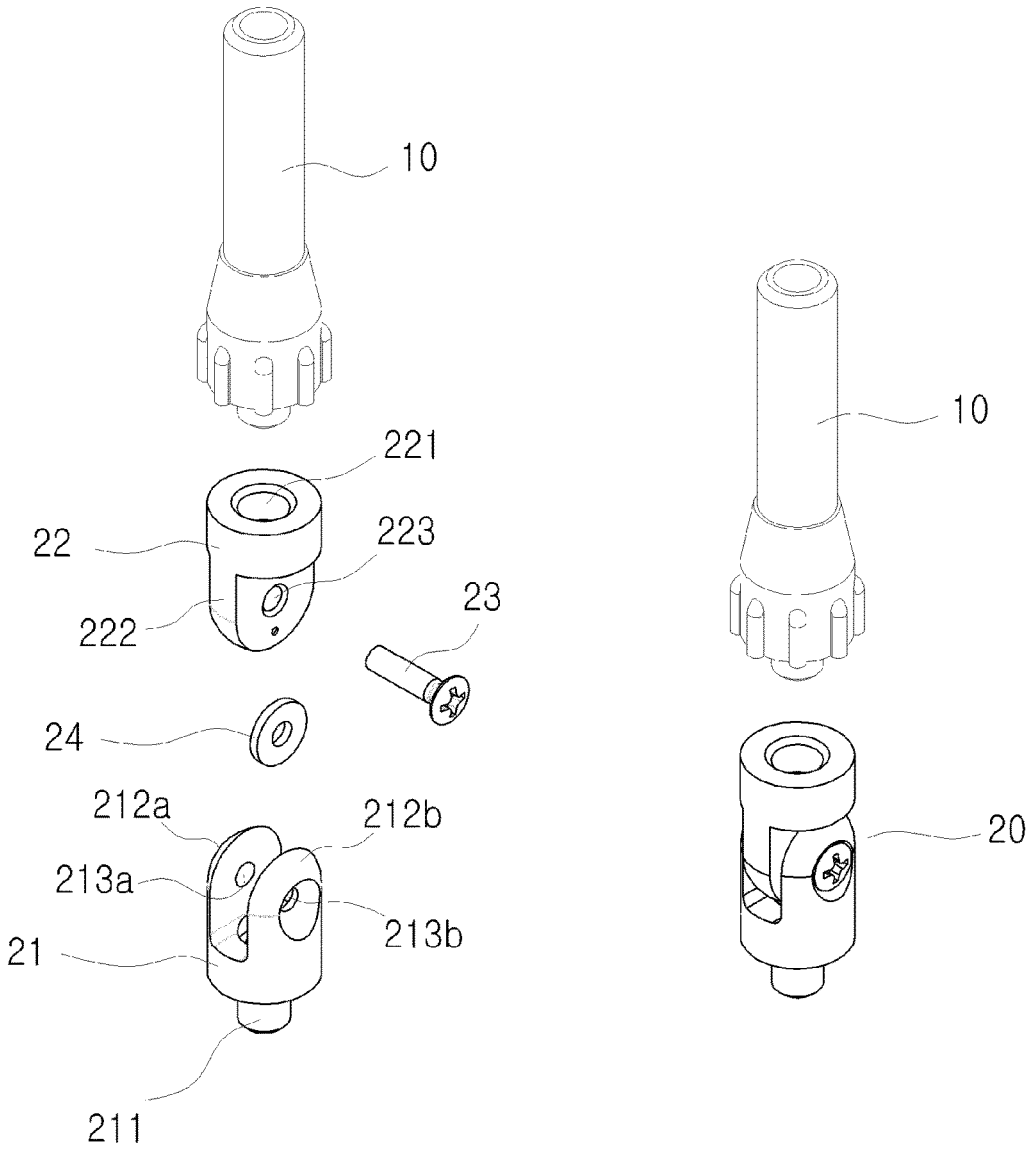
FIG. 3 is an exploded perspective view illustrating the antenna hinge connector according to the embodiment of the invention.
Figure 4:
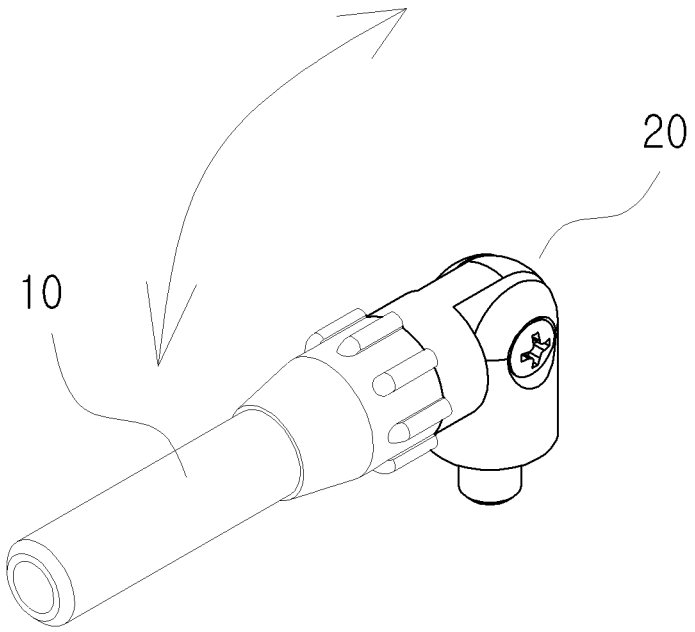
FIG. 4 is a diagram illustrating a pivoting operation of the antenna hinge connector according to the embodiment of the invention.
Figure 4:
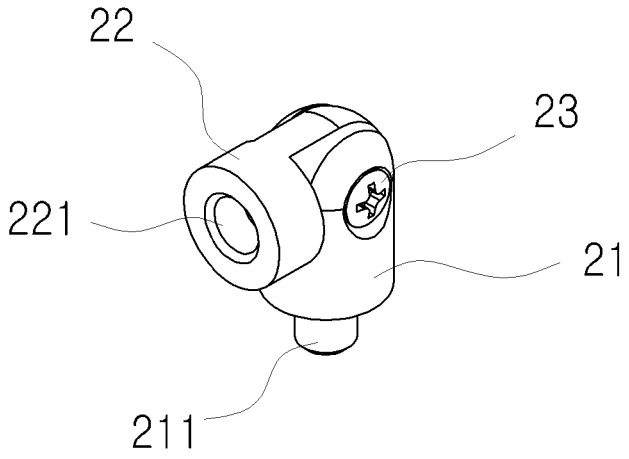

FIG. 2 is a diagram illustrating a state in which an antenna hinge connector is assembled according to an embodiment of the invention. FIG. 3 is an exploded perspective view illustrating the antenna hinge connector according to the embodiment of the invention. FIG. 4 is a diagram illustrating a pivoting operation of the antenna hinge connector according to the embodiment of the invention;

In FIGS. 2 to 4, a transmitter body 1, an antenna 10, an antenna hinge connector 20, a base body 21, a body connecting portion 211, hinge coupling pieces 212*a* and 212*b* (hereinafter generically referenced by "212"), first through-holes 213*a* and 213*b* (hereinafter generically referenced by "213"), a pivot body 22, an antenna connecting groove 221, a base coupling piece 222, a second through-hole 223, a rotating coupling portion 23, and a washer 24 are illustrated.

The antenna hinge connector 20 according to the embodiment of the invention is installed at the lower end of an antenna installed in the transmitter body such that the antenna can perform a pivoting operation to arbitrarily adjust a tip direction of the antenna, thereby improving a user's feeling of wearing and improving transmitting/receiving sensitivity. Here, a transmitter refers to a device that transmits a signal to a remote animal training device and includes a device having only a transmitting function and a device having both a transmitting function and a receiving function.

The antenna hinge connector 20 according to this embodiment includes the base body 21 and the pivot body 22 as a basic configuration.

The body connecting portion 211 is formed on the bottom surface of the base body 21. The body connecting portion 211 may have an external thread structure with the same size and standard as the connecting portion 12 of the antenna 10. Accordingly, the body connecting portion 211 has a shape corresponding to the antenna installation groove 11, and enables the base body 21 instead of the antenna 10 to be strongly coupled and fixed to the transmitter body 1.

The hinge coupling pieces 212 are formed to protrude from the top surface of the base body 21. The hinge coupling pieces 212 are configured as a group of two and are separated a constant gap to face each other. The base coupling piece 222 of the pivot body 22 which will be described later is inserted into a space between the hinge coupling pieces 212. The gap between the hinge coupling pieces 212 is determined to correspond to the thickness of the base coupling piece 222.

The hinge coupling pieces 212 are hinge portions enabling the pivot body 22 to perform a pivoting operation, and the first through-holes 213 are formed such that the rotating coupling portion 23 serving as a hinge shaft can be assembled thereto in a horizontal direction are formed in the hinge coupling pieces 212.

The top ends of the hinge coupling pieces 212 have a semicircular shape centered on the first through-holes 213 to avoid interference with the pivoting operation of the pivot body 22.

An antenna connecting groove 221 is formed on the top surface of the pivot body 22. The antenna connecting groove 221 may have an internal thread structure with the same size and standard as the antenna installation groove 11 of the transmitter body 1. Accordingly, the antenna connecting groove 221 has a shape corresponding to the connecting portion 12 of the antenna 10, and the antenna 10 is strongly coupled and fixed to the pivot body 22 instead of the transmitter body 1.

A base coupling piece 222 is formed to protrude from the bottom surface of the pivot body 22. The base coupling piece 222 has a flat panel shape standing upright, and a second through-hole 223 corresponding to the first through-holes 213 is formed at the center thereof. The bottom end of the base coupling piece 222 may have a semicircular shape centered on the second through-hole 223 to avoid interference when the pivot body 22 performs a pivoting operation.

When the base body 21 and the pivot body 22 are coupled to each other, the first through-holes 213 and the second through-hole 223 are located at the same height to communicate with each other.

The pivot body 22 is coupled to the base body 21 and then a rotating coupling portion 23 is fastened to the first through-holes 213 and the second through-hole 223 communicating with each other, whereby assembly of the antenna hinge connector 20 is completed. In this embodiment, the rotating coupling portion 23 may be a coupling screw.

In this case, the rotating coupling portion 23 serves as a hinge shaft and the pivot body 22 can hinge-rotate relative to the base body 21. Accordingly, the antenna 10 connected to the pivot body 22 can hinge-rotate relative to the transmitter body 1 connected to the base body 21 with the rotating coupling portion 23 as a hinge shaft, that is, can perform a pivoting operation.

Here, a washer 24 may be interposed between the hinge coupling pieces 212 and the base coupling piece 222. A through-hole of the washer 24 can be located at the same height as the first through-holes 213 and the second through-hole 223 to communicate with each other and can be fastened by the rotating coupling portion 23.

The washer 24 enhances a fastening force of the rotating coupling portion 23 and prevents the rotating coupling portion 23 from being loosened even when a pivoting operation is often performed. When the pivot body 22 has a predetermined pivot angle with respect to the base body 21 by the pivoting operation, the pivot body can be maintained at the corresponding angle and the antenna 10 can be directed in a direction desired by a user.

A case in which the hinge coupling pieces 212 are formed as a group of two is illustrated in the drawings, but this configuration is only an example and a configuration with a group of one hinge coupling piece may be employed depending on embodiments.

In this embodiment, the base body 21 and the pivot body 22 are formed of a conductor such as a metal or a semiconductor such that transmission of various signals can be smoothly achieved between the antenna 10 and the transmitter body 1.

Figure 5:
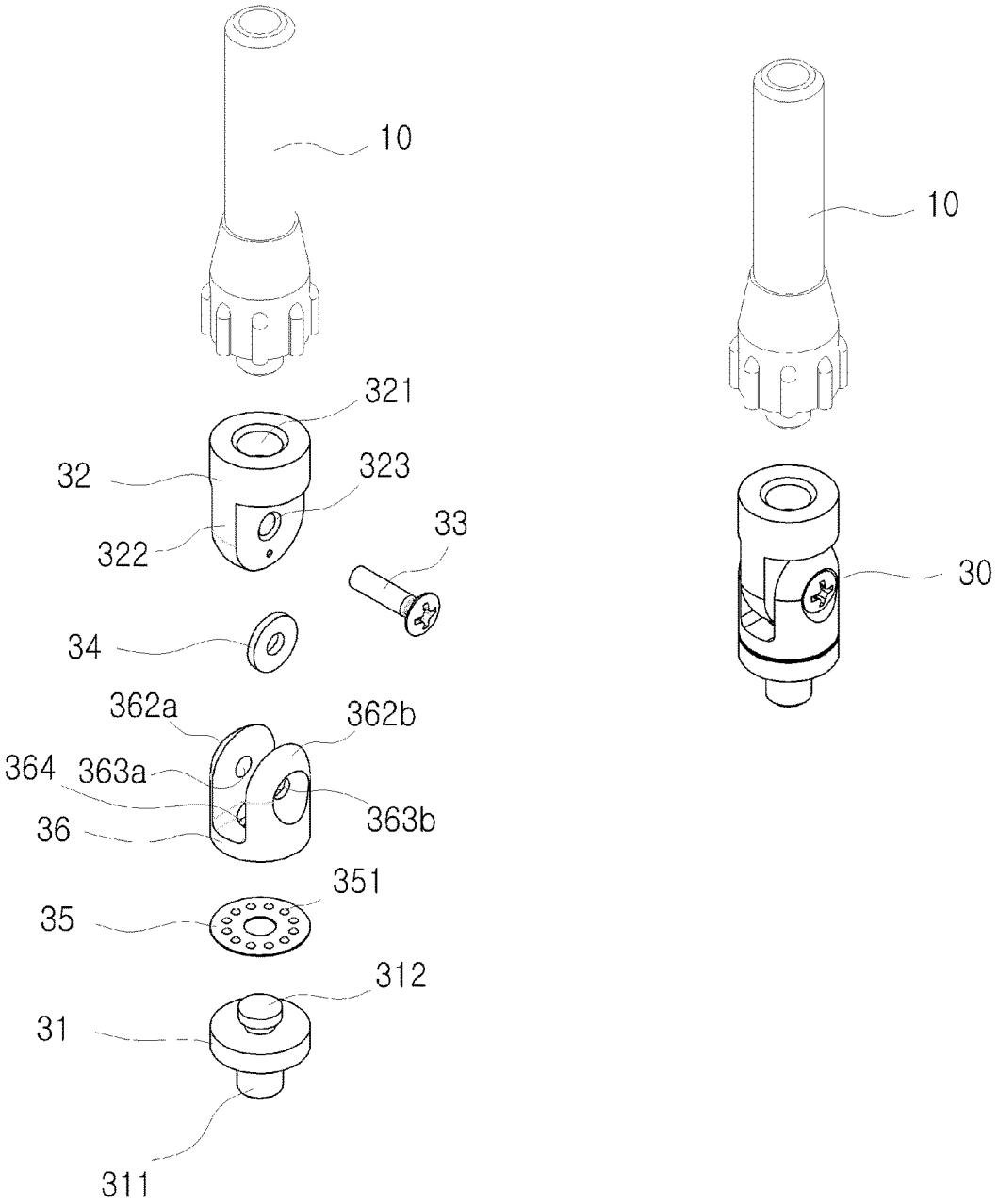
FIG. 5 is an exploded perspective view illustrating an antenna hinge connector according to another embodiment of the invention.
Figure 6:
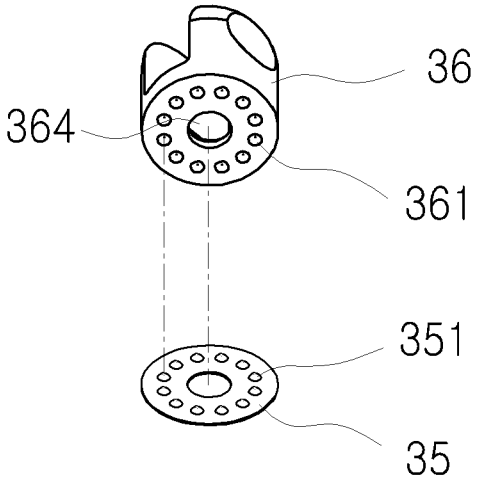
FIG. 6 is a diagram illustrating a coupling surface of a swivel body and a leaf spring.
Figure 7:
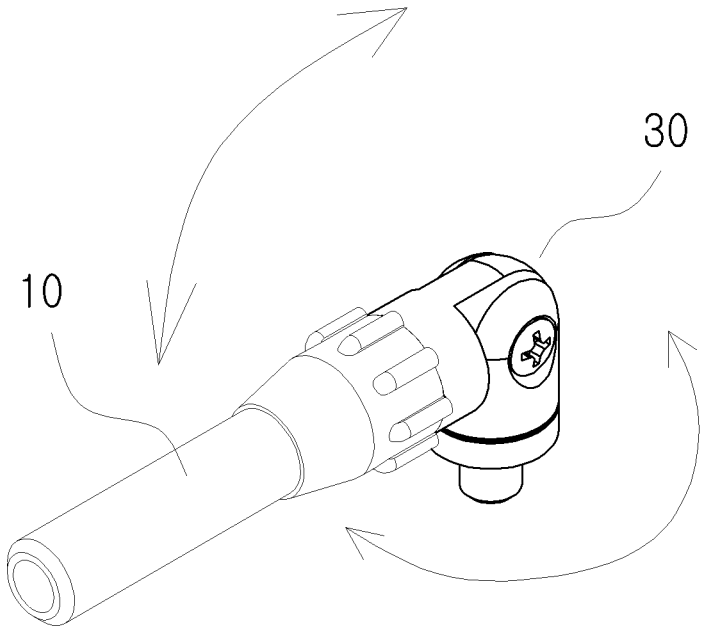
FIG. 7 is a diagram illustrating a pivoting/swiveling operation of an antenna hinge connector according to another embodiment of the invention.
Figure 8:
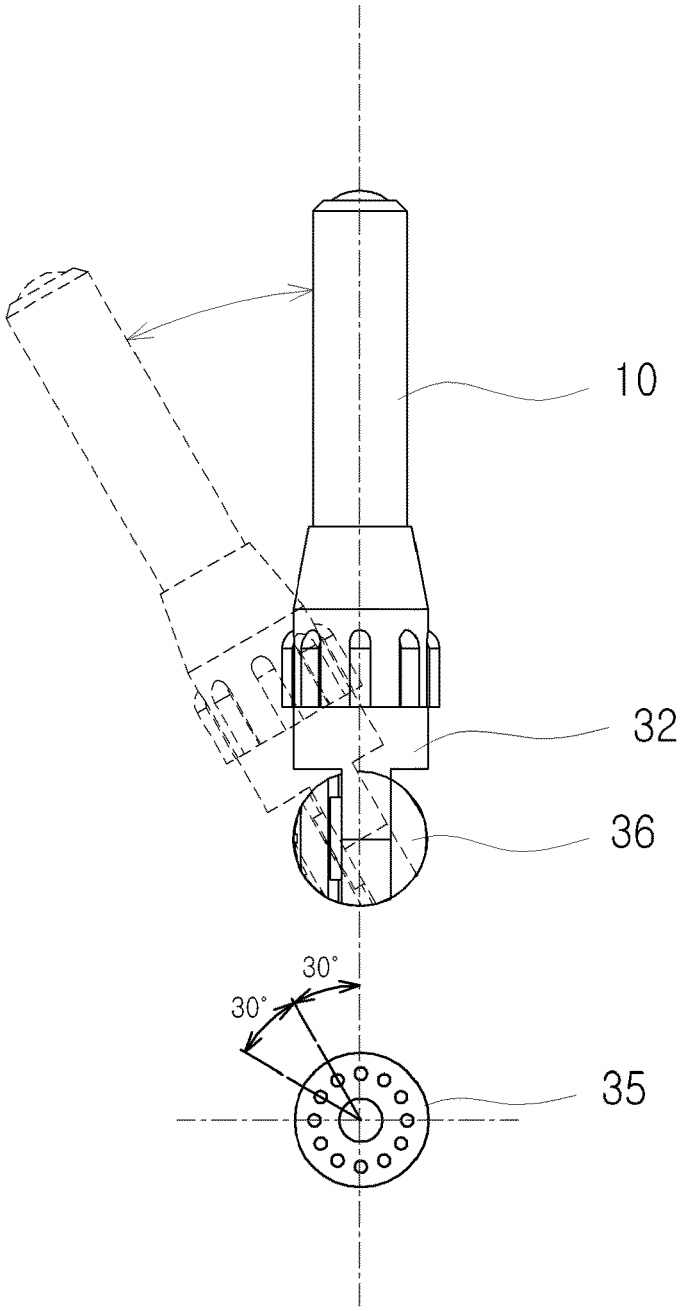
FIG. 8 is a diagram illustrating a swiveling operation of an antenna hinge connector according to another embodiment of the invention when it is viewed from upside.

FIG. 5 is an exploded perspective view illustrating an antenna hinge connector according to another embodiment of the invention. FIG. 6 is a diagram illustrating a coupling surface of a swivel body and a leaf spring. FIG. 7 is a diagram illustrating a pivoting/swiveling operation of an antenna hinge connector according to another embodiment of the invention. FIG. 8 is a diagram illustrating a swiveling operation of an antenna hinge connector according to another embodiment of the invention when it is viewed from upside.

In FIGS. 5 to 8, an antenna 10, an antenna hinge connector 30, a base body 31, a body connecting portion 311, a swivel connecting portion 312, a leaf spring 35, a fastening protrusion 351, a swivel body 36, hinge coupling pieces 362*a* and 362*b* (which may be hereinafter generically denoted by "362"), first through-holes 363*a* and 363*b* (which may be hereinafter generically denoted by "363"), a swivel connecting hole 364, a fastening groove 361, a pivot body 32, an antenna connecting groove 321, a base coupling piece 322, a second through-hole 323, a rotating coupling portion 33, and a washer 34 are illustrated.

The antenna hinge connector 30 according to another embodiment of the invention is installed at a bottom end of an antenna connected to a transmitter body to enable a swiveling operation of an antenna as well as a pivoting operation, and a direction in which the antenna is directed can be various adjusted three-dimensionally. Accordingly, it is possible to improve a user's feeling of wearing and to improve transmitting/receiving sensitivity.

The antenna hinge connector 30 according to this embodiment includes the base body 31, the swivel body 36, and the pivot body 32 as a basic configuration.

The body connecting portion 311 is formed on the bottom surface of the base body 31. The body connecting portion 311 may have an external thread structure with the same size and standard as the connecting portion 12 of the antenna 10. Accordingly, the body connecting portion 311 enables the base body 31 instead of the antenna 10 to be strongly coupled and fixed to the transmitter body 1.

The swivel connecting portion 312 is formed to protrude from the top surface of the base body 31. The swivel connecting portion 312 includes a top plate having a disc shape with a first diameter and a support having a cylinder shape with a second diameter smaller than the first diameter. The swivel body 36 which will be described later is coupled to the swivel connecting portion 312 such that the swivel connecting portion 312 can rotate 360 degrees about a vertical axis.

A swivel connecting hole 364 to which the swivel connecting portion 312 is fastened is formed at the center of the swivel body 36. The swivel connecting hole 364 has a third diameter between the first diameter and the second diameter and has a structure in which the top plate of the swivel connecting portion 312 is hooked such that the swivel body 36 can rotate smoothly without being separated from the base body 31.

The leaf spring 35 is interposed between the base body 31 and the swivel body 36. A through-hole corresponding to the second diameter is formed at the center of the leaf spring 35 such that the leaf spring 35 can be inserted and coupled to the support.

The fastening protrusion 351 is formed to protrude from the top surface of the leaf spring 35. A fastening groove 361 having a size corresponding to the fastening protrusion 351 is formed on the bottom surface of the swivel body 36. The fastening protrusion 351 can be inserted into the fastening groove 361. In this case, the swivel body 36 can be stably fixed to the base body 31 at a specific swivel angle.

The leaf spring 35 can be coupled and fixed to the top surface of the base body 31. For example, a coupling method such as welding or bonding can be used. This is for allowing the swivel body 36 to swivel by a desired amount with the leaf spring 35 fixed.

That is, when the leaf spring 35 is interposed and fastened between the base body 31 and the swivel body 36, an angle at which the swivel body 36 swivels with respect to the base body 31 and is then fixed can be limited by the fastening protrusion 351 and the fastening groove 361. Referring to FIG. 8, a minimum swivel angle which is fixable can be determined depending on intervals of the fastening protrusions 351, intervals of the fastening grooves 361 or a combination thereof. In the drawing, the angle is exemplified to be 30 degrees n.

The antenna can swivel and face a fixed swivel angle by the leaf spring 35, whereby the antenna can be fixed to a direction desired by a user.

In the drawing, an example in which a plurality of fastening protrusions 351 and a plurality of fastening grooves 361 are formed and arranged radially at constant intervals is illustrated. However, in some embodiments, a similar advantage can be achieved even in a case in which only one fastening protrusion 351 is formed and a plurality of fastening grooves 361 are formed.

In this embodiment, the fastening protrusions and the fastening grooves are sued as means for fixing an angle in a swiveling operation, but the fastening protrusions may be formed on the bottom surface of the swivel body and the fastening grooves may be formed on the leaf spring in some embodiments.

The hinge coupling pieces 362 are formed to protrude from the top surface of the swivel body 36. The hinge coupling pieces 362 are configured as a group of two and are separated a constant gap to face each other. The base coupling piece 322 of the pivot body 32 which will be described later is inserted into a space between the hinge coupling pieces 362. The gap between the hinge coupling pieces 362 is determined to correspond to the thickness of the base coupling piece 322.

The hinge coupling pieces 362 are hinge portions enabling the pivot body 32 to perform a pivoting operation, and the first through-holes 363 are formed such that the rotating coupling portion 33 serving as a hinge shaft can be assembled thereto in a horizontal direction are formed in the hinge coupling pieces 362. The top ends of the hinge coupling pieces 362 have a semicircular shape centered on the first through-holes 363 to avoid interference with the pivoting operation of the pivot body 32.

An antenna connecting groove 321 is formed on the top surface of the pivot body 32. The antenna connecting groove 321 may have an internal thread structure with the same size and standard as the antenna installation groove 11 of the transmitter body 1. Accordingly, the antenna connecting groove 321 enables the antenna 10 to be strongly coupled and fixed to the pivot body 32 instead of the transmitter body 1.

The base coupling piece 322 is formed to protrude from the bottom surface of the pivot body 32. The base coupling piece 322 has a flat panel shape standing upright, and a second through-hole 323 corresponding to the first through-holes 363 is formed at the center thereof. The bottom end of the base coupling piece 322 may have a semicircular shape centered on the second through-hole 323 to avoid interference when the pivot body 32 performs a pivoting operation.

When the swivel body 36 and the pivot body 32 are coupled to each other, the first through-holes 363 and the second through-hole 323 are located at the same height to communicate with each other.

The pivot body 32 is coupled to the swivel body 36 and then the rotating coupling portion 33 is fastened to the first through-holes 363 and the second through-hole 323 communicating with each other, whereby assembly of the antenna hinge connector 20 is completed. In this case, the rotating coupling portion 33 serves as a hinge shaft and the pivot body 32 can hinge-rotate relative to the swivel body 36. Accordingly, the antenna 10 connected to the pivot body 32 can hinge-rotate relative to the transmitter body 1 connected to the swivel body 36 and the base body 31 with the rotating coupling portion 23 as a hinge shaft, that is, can perform a pivoting operation.

Here, a washer 34 may be interposed between the hinge coupling pieces 362 and the base coupling piece 322. A through-hole of the washer 34 can be located at the same height as the first through-holes 363 and the second through-hole 323 to communicate with each other and can be fastened by the rotating coupling portion 33.

The washer 34 enhances a fastening force of the rotating coupling portion 33 and prevents the rotating coupling portion 33 from being loosened even when a pivoting operation is often performed. When the pivot body 32 has a predetermined pivot angle with respect to the swivel body 36 by the pivoting operation, the pivot body can be maintained at the corresponding angle and the antenna 10 can be directed in a direction desired by a user.

A case in which the hinge coupling pieces 362 is formed as a group of two is illustrated in the drawings, but this configuration is only an example and a configuration with a group of one hinge coupling piece may be employed depending on embodiments.

In this embodiment, the base body 31, the leaf spring 35, the swivel body 36, and the pivot body 32 are formed of a conductor such as a metal or a semiconductor such that transmission of various signals can be smoothly achieved between the antenna 10 and the transmitter body 1.

While the invention has been described above with reference to exemplary embodiments, it will be understood by those skilled in the art that the invention can be modified and changed in various forms without departing from the concept and scope of the invention described in the appended claims.

What is claimed is:

1. An antenna hinge connector that is installed between a transmitter body and an antenna, the antenna hinge connector comprising:

a base body in which a body connecting portion corresponding to an antenna installation groove of the transmitter body is formed on a bottom surface thereof and a swivel connecting portion is formed on a top surface thereof;

a swivel body in which a swivel connecting hole corresponding to the swivel connecting portion is formed on a bottom surface thereof to fasten the swivel body to the base body to swivel and a hinge coupling piece is installed to protrude from a top surface thereof;

a pivot body in which an antenna connecting groove corresponding to a connecting portion of the antenna is formed on a top surface thereof and a base coupling piece corresponding to the hinge coupling piece is installed to protrude from a bottom surface; and a rotating coupling portion that rotatably couples the hinge coupling piece and the base coupling piece, wherein the body connecting portion is connected to the transmitter body and the antenna is connected to the antenna connecting groove.

2. The antenna hinge connector according to claim 1, wherein a leaf spring in which a fastening protrusion is formed on a top surface thereof is interposed between the base body and the swivel body, and a fastening groove corresponding to the fastening protrusion is formed on the bottom surface of the swivel body.

3. The antenna hinge connector according to claim 1, wherein a leaf spring in which a fastening groove is formed on a top surface thereof is interposed between the base body and the swivel body, and a fastening protrusion corresponding to the fastening groove is formed on the bottom surface of the swivel body.

4. The antenna hinge connector according to claim 2, wherein a plurality of fastening grooves are arranged in a radial shape, and a fixable minimum angle when the swivel body swivels is determined depending on an angle between the fastening grooves.

5. The antenna hinge connector according to claim 3, wherein a plurality of fastening grooves are arranged in a radial shape, and a fixable minimum angle when the swivel body swivels is determined depending on an angle between the fastening grooves.

6. The antenna hinge connector according to claim 1, wherein the pivot body rotates about the swivel body when a pivoting operation is performed.

7. The antenna hinge connector according to claim 1, wherein a washer is interposed between the hinge coupling piece and the base coupling piece.

* * * * *